US005116057A

United States Patent [19]

Mangiaracina

[11] Patent Number: 5,116,057

[45] Date of Patent: May 26, 1992

[54] GOLF TRAINING AID

[76] Inventor: Michael Mangiaracina, 7840 SW 86th St. #21, Miami, Fla. 33143

[21] Appl. No.: 758,560

[22] Filed: Sep. 12, 1991

[51] Int. Cl.[5] ..... A63B 69/36

[52] U.S. Cl. ..... 273/183 B; 273/166; 273/77 R; 273/DIG. 30; 273/186 A

[58] Field of Search ..... 273/189 A, 166, 165, 273/DIG. 30, 183 B, 77 R, 77 B

[56] References Cited

U.S. PATENT DOCUMENTS 802,623 10/1905 Camp ..... 273/189 A
3,274,616 9/1966 Russo ..... 273/166 X
3,368,811 2/1968 Finney ..... 273/166
4,718,677 1/1988 Barnes ..... 273/DIG. 30

*Primary Examiner*—George J. Marlo
*Attorney, Agent, or Firm*—Katherine McGuire

[57] ABSTRACT

A golf training aid comprises a cuff for releasable attachment about the wrist of the golfer's leading arm and a sleeve for releasable attachment to the grip of a golf club. A hook Velcro patch is attached to the cuff and a pile Velcro patch is attached to the grip sleeve such that when the golfer grasps the club the Velcro on the cuff attaches to the Velcro on the grip. When executing a short stroke such as a putt, the wrist of the leading arm should stay close to the grip. If it does not, the Velcro patches separate creating an audible noise informing the golfer of the incorrect movement.

4 Claims, 3 Drawing Sheets

GOLF TRAINING AID

BACKGROUND OF THE INVENTION

This invention relates to devices designed to train a golfer to execute a proper swing of the golf club and, more particularly, to such a device which is specifically aimed at improving the "short" stroke a golfer executes when making putt and chip shots, for example.

Many training aids have been developed for the game of golf which are directed towards improving the player's golf swing and grip upon the club. For example, U.S. Pat. No. 4,057,255, issued to Bishop on Nov. 8, 1977, discloses a specialized golf glove which is aimed at maintaining proper wrist movement throughout a full back swing. The glove operates by becoming taut on the down swing such that the golfer will feel this and not ben his wrist downwardly any further. A training device aimed more at improving the proper arm movement with respect to the body during a full back swing may be seen in U.S. Pat. No. 4,982,317, issued to Corder, Jr. on Jan. 9, 1990. A chest strap in combination with an arm strap including Velcro attachments are worn by the golfer. A connector strap releasably attaches at either end to the chest strap and the arm strap by Velcro attachments. Should the golfer's full back swing exceed the prescribed swing, the Velcro on the connector strap releases from the arm and/or chest strap producing an audible ripping sound which informs the golfer of the incorrect swing.

Various training devices aimed at improving hand placement an grip upon the club may be seen in U.S. Pat. No. 4,752,075, issued to Bencriscutto on Jun. 21, 1988; U.S. Pat. No. 4,665,565, issued to Odom on May 19, 1987; U.S. Pat. No. 3,368,811, issued to Finney on Feb. 13, 1968; U.S. Pat. No. 3,559,212, issued to Skovron on Feb. 2, 1971; and U.S. Pat. No. 3,532,344, issued to Masstab on Oct. 6, 1970. Although the above mentioned patents seem to be effective for their intended purpose, there exists a need for a golf training device which is directed specifically at improving the proper arm and wrist movement involved in executing a short stroke with a golf club.

It is therefore a principle object of the present invention to provide a golf training aid which is very effective at improving a golfer's short stroke.

It is another object of the present invention to provide a golf training aid which conditions a golfer to refrain from breaking (i.e., "bending") his leading wrist and arm away from the club grip throughout a short stroke by incorporating both visual and audible means of informing the golfer of the break of his leading wrist and arm which is undesirable.

It is a further object of the present invention to provide a golf training aid which is simple in design, easy to use and otherwise economically attractive.

Other objects will in part be obvious and in part appear hereinafter.

SUMMARY OF THE INVENTION

In accordance with the foregoing objects, the invention comprises a cuff for releasable attachment about the wrist of the leading arm of the golfer. The cuff includes a patch of pile Velcro which should be positioned along the inside of the wrist when the cuff is attached to the wrist in the intended manner.

A grip sleeve is provided comprising a tubular section of elastic material which may be removably fit over the grip of the club. A patch of hook Velcro is attached thereto and is positioned along the side of the grip which faces the golfer's leading arm such that the pile Velcro patch on the golfer's wrist cuff may releasably attach to the hook Velcro patch on the grip sleeve. As such, the golfer addresses his ball in the usual manner with his leading arm substantially straight. The golfer presses his cuffed wrist against the grip sleeve to secure the respective Velcro patches together. In this position, the golfer's leading arm and wrist are in correct alignment with the club. As the golfer executes a short stroke of the club to hit the ball, the leading arm and wrist should remain substantially straight with the movement coming from the shoulders. Should the golfer bend his leading arm and wrist during any part of the stroke, the wrist moves away from the club grip and the Velcro fasteners separate resulting in an audible ripping noise which informs the golfer of the incorrect arm movement.

DETAILED DESCRIPTION

Figure 1:
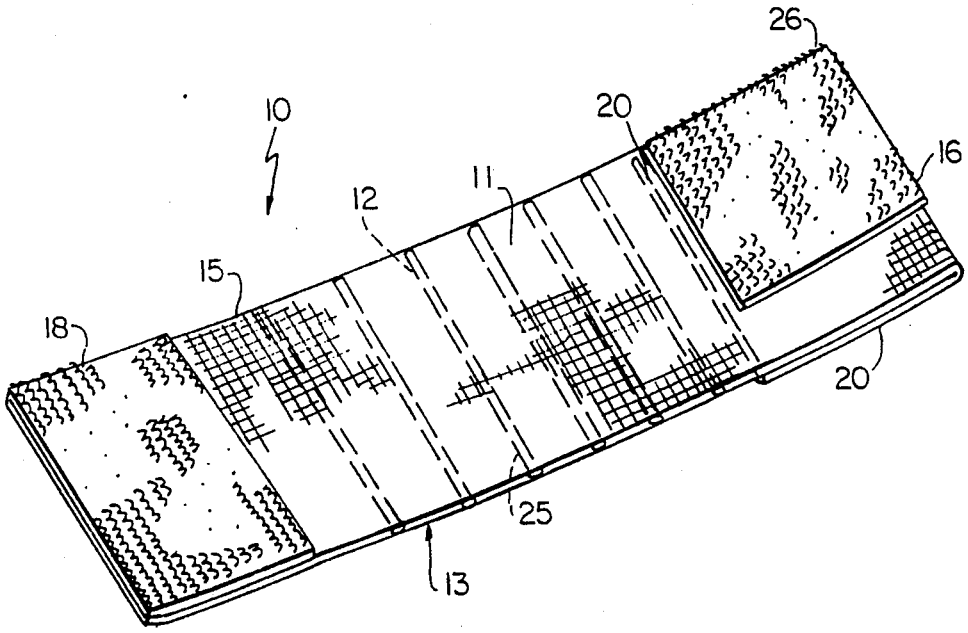
FIG. 1 is a perspective view of the wrist cuff in the unattached condition.
Figure 2:
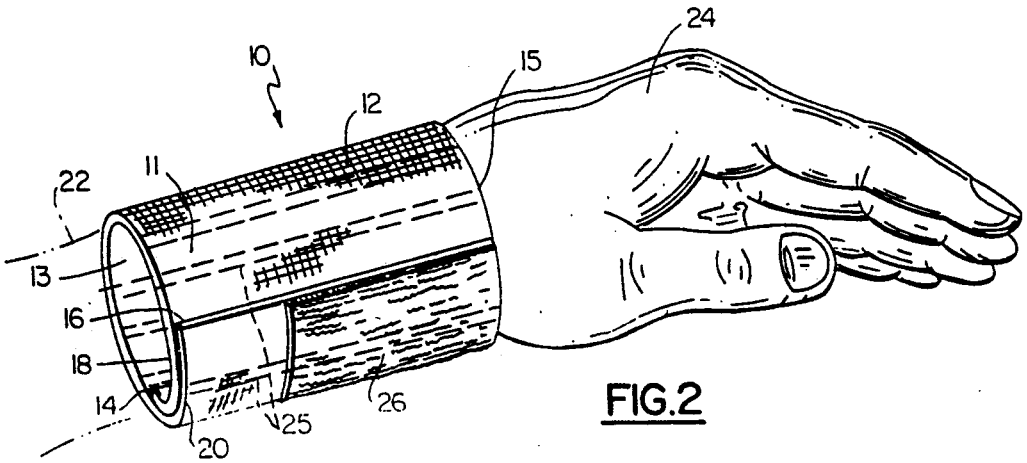
FIG. 2 is a perspective view of the wrist cuff seen attached to a golfer's wrist in the intended manner, the golfer's arm seen partially in phantom extending therefrom.

Referring now to the drawings, there is seen in FIG. 1 the wrist cuff element of the invention designated generally by the numeral 10. Cuff 10 comprises a rectangular piece of flexible material 12 including means to secure opposite edges 14 and 16 together about one's wrist. Securing means shown and described herein are in the form of Velcro fasteners with a pile Velcro patch 18 attached to a first, outer surface 11 of material 12 adjacent edge 14 and a hook Velcro patch 20 attached to the opposite, inside surface 13 of material 12 adjacent edge 16. Referring to FIG. 2, cuff 10 is secured about the golfer's wrist 22 by laying the inside surface 13 of material 12 against the wrist 22, wrapping cuff 10 about the wrist and securing hook Velcro patch 20 over pile Velcro patch 18. In the attached condition, the edge 15 of cuff 10 lies adjacent the hand 24 of the golfer. A plurality of laterally spaced, rigid rods 25 are sewn into material 12 to help maintain cuff 10 in the proper position upon the wrist.

As seen in both FIGS. 1 and 2, a pile Velcro patch 26 is attached to material 12 on the outside surface 11 thereof adjacent edges 15 and 16, opposite to Velcro patch 20. In the attached condition of the cuff 10 seen in FIG. 2, Velcro patch 26 lies along the inside of wrist 22 to releasably attach to the second element of the invention described below.

Figure 4:
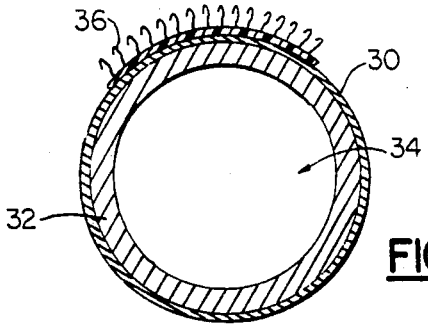
FIG. 4 is a cross-sectional view of the golf club grip and grip sleeve as taken generally along the line 4—4 in FIG. 3.
Figure 3:
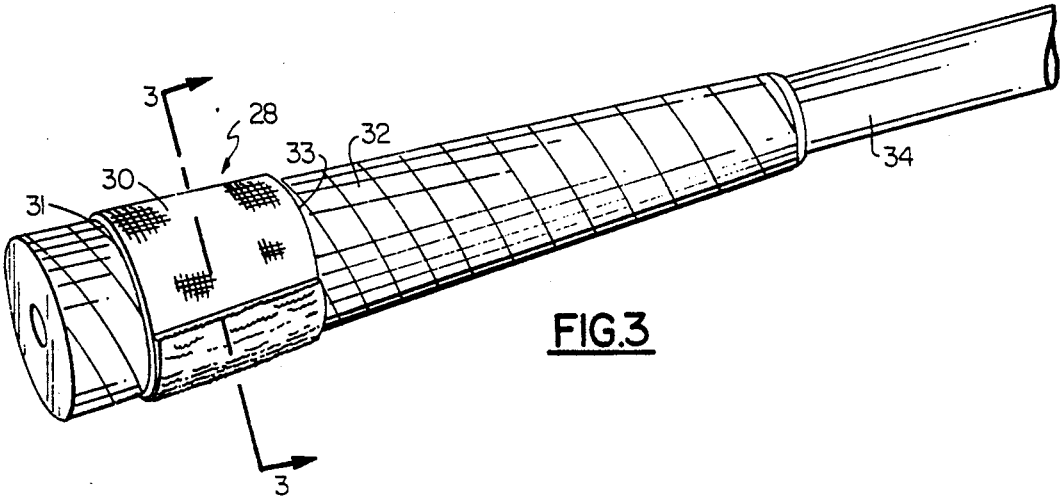
FIG. 3 is a perspective, fragmentary view of the proximal end of a golf club with the grip sleeve shown secured about the upper portion of the golf club grip in the intended manner.

Referring to FIGS. 3 and 4, the grip sleeve element 28 of the invention is seen to comprise a tubular segment 30 of elasticized material such as soft rubber, for example, which may be manipulated over the grip 32 of a golf club shaft 34. Segment 30 is seen to include a hook Velcro patch 36 affixed to one section thereof, extending from top edge 31 to bottom edge 33. It should be apparent that by virtue of the elastic nature of segment 30, grip sleeve 28 may be easily attached and removed from grip 32 as desired.

Figure 5:
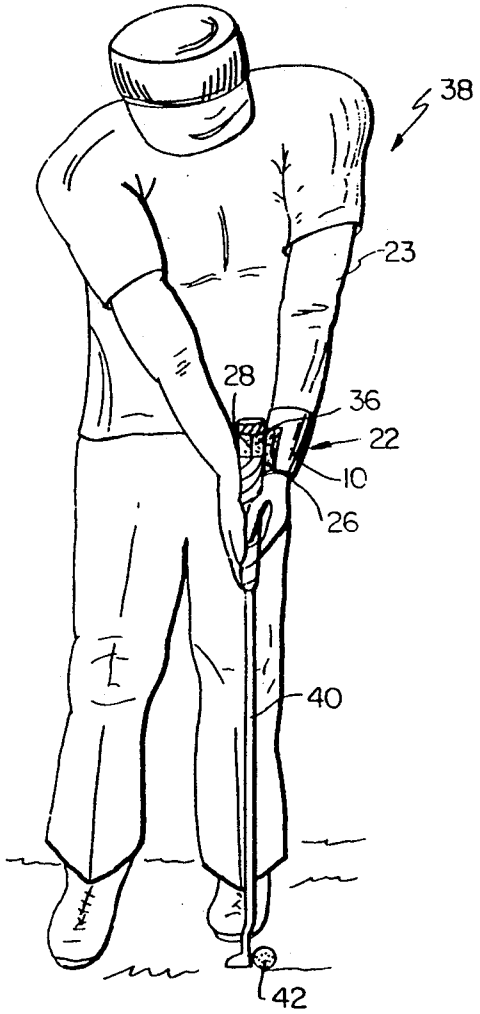
FIG. 5 is a front, elevational view of a golfer executing a short stroke using the present invention while maintaining his leading arm and wrist in the proper position with respect to the golf club.
Figure 6:
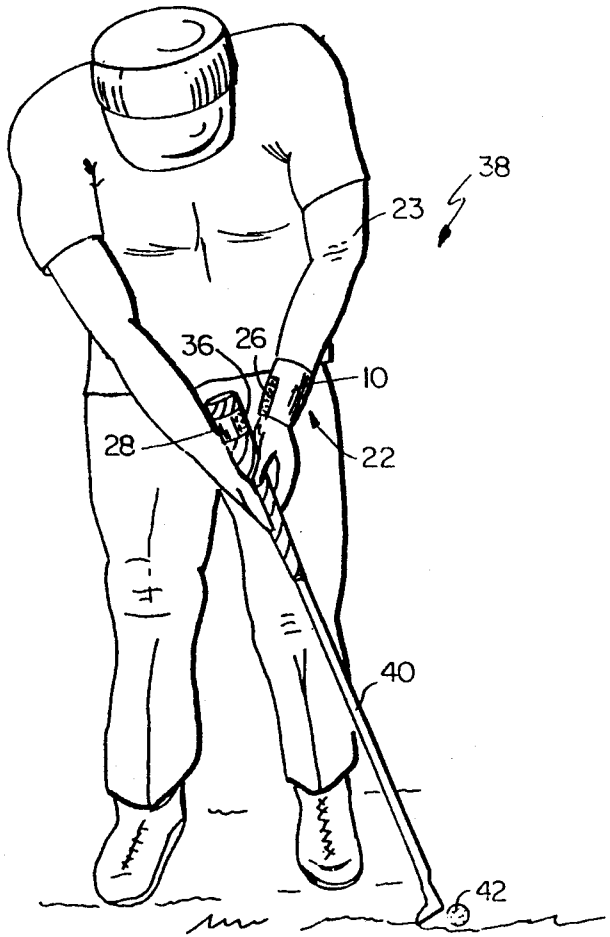
FIG. 6 is a front, elevational view of a golfer executing a short stroke using the present invention and failing to maintain his leading arm and wrist in proper position with respect to the golf club.

Referring now to the manner of use of the invention, attention is turned to FIGS. 5 and 6 which show a golfer 38 executing a short stroke with club 40 such as a putt, for example. In FIG. 5, which shows the correct orientation of the arms and shoulders during execution of a short stroke, wrist cuff 10 is attached to the golfer's leading wrist 22 with Velcro patch 26 facing inwardly to attach to Velcro patch 36 on grip sleeve 28. In the attached condition of the two elements of the invention, leading arm 23 and wrist 22 of golfer 38 are substantially straight with club grip 32 resting against leading wrist 22. During execution of a short stroke such as illustrated in FIGS. 5 and 6, the golfer swings club 40 toward the right to hit ball 42. As club 40 is swung to the right, the golfer should maintain his arm 23 and wrist 22 substantially straight and move with his shoulders. If he fails to do this, his leading wrist 22 breaks or bends with the result being that club 40 rises too early in the swing as seen in FIG. 6. The invention immediately informs the golfer of the incorrect arm and wrist movement when Velcro patch 26 on cuff 10 separates from Velcro patch 36 on grip sleeve 28. The first, most recognizable indication that the leading wrist has broken away from the grip is the ripping noise created upon separation of the Velcro patches 26 and 36. Other indications include the golfer both seeing the separation of the Velcro and feeling the pull upon his leading wrist as the grip sleeve 28 is forced away from the cuff 10.

Should the golfer break his wrist early in the stroke thereby detaching cuff 10 from grip sleeve 28, the aforementioned audible, visual and physical indications condition the golfer to maintain proper wrist movement throughout the stroke. Once detached, the golfer may quickly and easily reattach cuff 10 to grip sleeve 28 by pressing Velcro patches 26 and 36 together as seen in FIG. 5 thereby allowing rapidly repeated practice strokes to train the golfer more quickly and effectively than other known training methods. While the invention has been shown and described with particular reference to a preferred embodiment thereof, it will be clear to those skilled in this art that various modifications and changes may be made without departing from the full spirit and scope of the invention as defined by the claims that follow.

What is claimed is:

1. Apparatus for learning proper hand and wrist motion of a golfer's leading arm during execution of a short stroke with a golf club comprising, in combination:

a) a cuff having inside and outside surfaces including means releasably securing said cuff about the wrist of the leading arm of a golfer with said inside surface laying against and contacting said wrist and said outside surface facing away from said wrist, said cuff further including a first cooperative fastening element fixed to said outside surface thereof at the location of the inside of said wrist adjacent the palm of the hand;

b) a golf club including a proximal grip portion and a distal club head including a hitting face; and c) a sleeve having inside and outside surfaces removably attached in encircling relation to at least a portion of said grip portion of said club with said sleeve inside surface laying against and contacting said grip and said sleeve outside surface facing away from said grip, said sleeve including a second cooperative fastening element fixed to said outside surface thereof on the same side of the club as is said hitting face of said club head, said first cooperative fastening element upon the golfer manually gripping said grip portion of said club with the hand of said leading arm in the usual manner ready to strike a golf ball, said first cooperative fastening element on said cuff releasably fastening to said second cooperative fastening element on said sleeve upon said golfer pressing said first fastening element against said second fastening element, said first fastening element separable from said second fastening element upon moving said wrist in a direction away from said gripping portion during execution of said short stroke.

2. The invention according to claim 1 wherein said first and second fastening elements are hook and pile fabric patches, respectively.

3. A method of learning proper hand and wrist motion of a golfer's leading arm during execution of a short stroke with a golf club having a proximal grip portion and a distal head portion including a hitting face comprising the steps of:

a) attaching a cuff having inside and outside surfaces to the wrist of the leading arm with said inside surface laying against and contacting said wrist and said outside surface facing away from said wrist, said cuff further including a first cooperative fastening element fixed to said outside surface thereof at the location of the inside of said wrist adjacent the palm of said hand of said wrist;

b) removably attaching a second cooperative fastening element to said grip portion of the golf club on the same side of the club as said hitting face of said club head;

c) releasably fastening said first fastening element to said second fastening element by manually grasping said grip portion of the golf club with said hand of said leading arm in the conventional manner ready to hit the golf ball and pressing said first fastening element on said cuff to said second fastening element on said grip portion, improper arm and wrist movement of said leading arm being indicated during execution of a short stroke when said first fastening element separates from said second fastening element; and d) repeating step c) each time said first fastening element separates from said second fastening element during execution of said short stroke.

4. The method according to claim 3 wherein said first and second cooperative fastening elements are hook and pile fabric patches, respectively.

* * * * *